United States Patent [19]

Gzym et al.

[11] Patent Number: 4,555,880

[45] Date of Patent: Dec. 3, 1985

[54] ADJUSTABLE BASE FOR OFFICE LANDSCAPING SYSTEM

[75] Inventors: Larry P. Gzym, Rockford; Lloyd G. Ritzema, Lowell; David K. Haadsma, Jr., Wyoming, all of Mich.

[73] Assignee: Stow & Davis Furniture Company, Grand Rapids, Mich.

[21] Appl. No.: 425,502

[22] Filed: Sep. 28, 1982

Related U.S. Application Data

[63] Continuation-in-part of Ser. No. 358,091, Mar. 15, 1982, Pat. No. 4,449,337.

[51] Int. Cl.[4] ..... E04B 2/82

[52] U.S. Cl. ..... 52/126.4; 52/127.7; 52/242; 52/263

[58] Field of Search ..... 52/126.3, 126.4, 126.5, 52/126.6, 126.7, 122.1, 222, 241, 242, 243.1, 290, 678, 698, 262, 263, 127.7; 248/354.3, 354.4, 357

[56] References Cited

U.S. PATENT DOCUMENTS

| | | | |
|---|---|---|---|
| 2,422,795 | 6/1947 | McKnight | 248/354.4 |
| 2,540,622 | 2/1951 | Langenberg | 52/293 |
| 2,877,875 | 3/1959 | Bolt | 52/713 |
| 3,111,723 | 11/1963 | Bates | 52/243 |
| 3,190,405 | 6/1965 | Squire | 52/655 |
| 3,216,678 | 11/1965 | Foedisch | 248/1 |
| 3,386,216 | 6/1968 | Zwickert | 52/205 |
| 3,470,663 | 10/1969 | Tate | 52/263 |
| 3,664,073 | 5/1972 | Tucker | 52/127.7 |
| 3,771,273 | 11/1973 | Brodie | 52/646 |
| 3,885,361 | 5/1975 | DeSchutter | 52/126.4 |
| 3,899,857 | 8/1975 | Mochizuki | 52/126.4 |
| 3,979,865 | 9/1976 | Tillie | 52/126.3 |
| 4,056,903 | 11/1977 | Guarnere | 52/126.4 |
| 4,086,734 | 5/1978 | Hayashi | 52/126.4 |
| 4,103,463 | 8/1978 | Dixon | 52/126.4 |
| 4,188,758 | 2/1980 | Swann | 52/281 |
| 4,407,101 | 10/1983 | Propst et al. | 52/126.3 |
| 4,449,337 | 5/1984 | Gzym et al. | 52/126.4 |

FOREIGN PATENT DOCUMENTS

| | | | |
|---|---|---|---|
| 450306 | 8/1948 | Canada | 248/357 |
| 2510949 | 9/1976 | Fed. Rep. of Germany | 52/126.4 |
| 404164 | 6/1966 | Switzerland | 52/126.4 |
| 1121442 | 7/1968 | United Kingdom | 52/127.7 |

*Primary Examiner*—John E. Murtagh
*Assistant Examiner*—Andrew Joseph Rudy
*Attorney, Agent, or Firm*—Price, Heneveld, Huizenga & Cooper

[57] ABSTRACT

The specification discloses a wall panel base construction including a foot, a wall panel supporting assembly, and a plurality of oppositely threaded members extending between the foot and the supporting assembly. The lower portion of each threaded member is secured within a block, which is in turn pivotally supported on the foot to prevent the threaded members from jamming during height adjustment. The blocks are also laterally shiftable with respect to the foot to further accommodate movement of the threaded member during height adjustment. In a second aspect, the upper end of the threaded member includes a chuck for receiving a rotatable driving tool; and the panel supporting assembly defines an aperture axially aligned with the threaded member, whereby the chuck can be freely accessed to facilitate rotation of the member.

10 Claims, 5 Drawing Figures

ADJUSTABLE BASE FOR OFFICE LANDSCAPING SYSTEM

BACKGROUND OF THE INVENTION

This application is a continuation in part of copending application Ser. No. 358,091, filed Mar. 15, 1982, now U.S. Pat. No. 4,449,337, issued May 22, 1984, and entitled ADJUSTABLE BASE FOR OFFICE LANDSCAPING SYSTEM.

The present invention relates to a base construction for a wall panel assembly, and more specifically to a height-adjustable base construction.

Modular wall panel and furniture systems are used in a wide variety of applications because of their efficient and relatively inexpensive partitioning of a large open area into efficient office space. The modular constructions provide a relative high concentration of work stations within a given area.

Due to the fact that the panel systems are often installed on floors which are not level, for example in old buildings, it is necessary that the panel systems include means for plumbing, or leveling, the panels above an out-of-level floor. One such system includes a foot, a wall panel supporting assembly, and threaded members extending between, and threaded within, the foot and the support assembly. Each of the threaded members is oppositely threaded in opposite directions at its opposite ends so that when the threaded member is rotated in a first direction, the foot is withdrawn into the support assembly; and when rotated in a second direction, the foot is extended from the support assembly. Consequently, the threaded members may be individually adjusted to level the support assembly and the panels supported thereon. An example of such a system is disclosed in U.S. Pat. No. 4,407,101, entitled BASE CONSTRUCTION FOR PANEL, and issued Oct. 4, 1983, to the assignee of the present invention. Firstly, the threaded members have a tendency to be inclined from the vertical and jam when one threaded member is adjusted to a height significantly different from another threaded member so that the panel and support assembly are at relatively steep angles with respect to one another. Consequently, the height-adjusting mechanism is frequently difficult to adjust and forcing such adjustment results in ruining the mechanism during installation. Thus, the panels cannot be plumbed, or leveled, above a seriously out-of-level floor because the threaded members cannot be adjusted to significantly different heights without jamming the threaded members. Secondly, excessive labor is required to assemble the system for shipment and to subsequently level the system because the oppositely threaded member must be repeatedly grasped about its mid-portion and rotated a fraction of a turn to effect assembly and height adjustment.

Another adjustment base construction for wall panels as shown in U.S. Pat. No. 3,885,361, entitled BUILDING WALL PANEL LEVELER DEVICE, issued May 27, 1975, to DeSchutter, includes a leveler support track slidably supporting a leveler device which includes a lower support member slidable on the leveler support track and an upper support member on which a panel supporting member rests. A height adjusting means comprising a threaded bolt with a hexagonal head is located between the foot and the upper support member and is received by a threaded opening in the upper support member. Thus, rotating the bolt in one direction lifts the upper support member to lift the panel support, while rotating it in the opposite direction lowers the panel support. The bolt is pivotally supported on the lower support member by means of a ball-and-socket arrangement to permit the entire assembly to tilt toward or away from the opposite ends of the lower support member and/or the sliding of the lower support member on the leveler support track. Firstly, although we have not built and tested the ball-and-socket arrangement, we believe it is generally not sufficiently strong as is often necessary to support the relatively large weight of the panels and panel supporting assembly and the additional weight of cantilevered accessory components. Secondly, height adjustment of the base can be effected only through repeated fractional rotation of the threaded bolts.

SUMMARY OF THE INVENTION

The aforementioned problems are solved by the present invention. Essentially, a wall panel base construction is provided comprising a foot, a wall panel support assembly, and a plurality of height adjustment assemblies extending between the foot and the panel support assembly. Each height adjustment assembly includes an elongated adjustable member having an upper end threaded in the support assembly and a lower end threaded within a block, which in turn is pivotally supported on the foot. Any of the elongated members can be adjusted to any height, and accordingly inclined from the vertical, without fear of jamming that, or any other, adjustment member because the block will pivot to accommodate the inclination of the adjusted member. The cited structure has improved strength over known ball-and-socket arrangements due to the fact that the lower end of the height adjustment member is secured within a block, which in turn is pivotally supported on the foot. Consequently, the reliability and adjustability of the present base construction is greatly improved over known constructions.

In a preferred embodiment of the invention, the block is also mounted for longitudinal movement with respect to the foot. In this embodiment, the block may shift longitudinally with respect to the foot during height adjustment to accommodate the shifting lower end of the adjustment member inclination. This further reduces wear and fatigue forces within the base construction, increasing the reliability of the wall panel system.

In a second aspect of the invention, the base construction comprises a foot assembly, a wall panel support assembly, and a threaded member supporting the panel support assembly on the foot assembly. The upper end of the threaded member includes a chuck structure for receiving a rotatable driving tool, and the panel support structure defines a void aligned with and providing access to the chuck structure. Consequently, the threaded member can be rapidly rotated during assembly and leveling by driving the threaded member with a rotatable driving tool applied to the chuck structure through the panel support assembly.

These and other objects, advantages, and features of the invention will be more readily understood and appreciated by reference to the written specification and appended drawings.

DESCRIPTION OF THE PREFERRED EMBODIMENT

Figure 1:
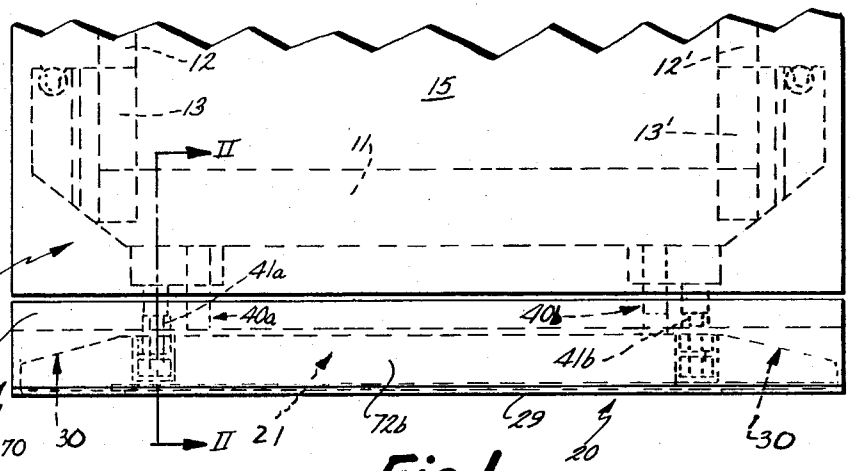
FIG. 1 is a fragmentary front plan view of the wall panel support base of the present invention with a support assembly and wall panel installed thereon.
Figure 5:
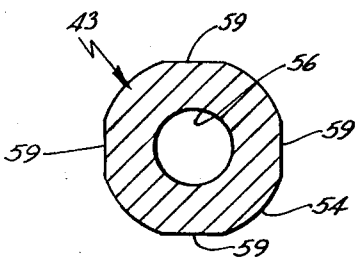
FIG. 5 is a sectional view taken along plane V—V in FIG. 3.

As disclosed in FIG. 1, the panel system of the present invention includes a wall panel support assembly 10, a foot assembly 20, an adjustment assembly 40 extending between the foot assembly and the panel support assembly, and an enclosure assembly 70 for hiding the adjustment assembly and for providing wire raceways. Adjustment assembly 40 (FIGS. 2, 3, and 4) includes a member 41 having oppositely threaded ends secured within socket 42 rigidly secured to support assembly 10 and block 43. Block 43 is pivotally supported on clip 44, which in turn is locked within, and supported on, foot assembly 20. When adjustment assembly 40*a* (FIG. 1) is adjusted to a significantly different height than adjustment assembly 40*b*, both of blocks 43*a* and 43*b* pivot within clips 44*a* and 44*b* to accommodate the inclined threaded members 41*a* and 41*b*. Additionally, blocks 43 shift laterally within clips 44 to accommodate inclined members 41. Consequently, threaded members 41 do not jam within sockets 42 and blocks 43.

Turning more specifically to the construction of the wall panel base, it is seen that assembly 10 includes a horizontal lower member 11, generally U-shaped in cross section; a vertical member 12, generally square in cross section; and a gusset 13 interconnecting the horizontal and vertical members. The construction of assembly 10 is more fully disclosed in U.S. Pat. No. 4,443,986, issued Apr. 24, 1984, entitled WALL PANEL CONSTRUCTION SYSTEM, and assigned to the assignee of the present invention. Channel member 11 is generally U-shaped in cross section including a pair of spaced side wall 11*a* and 11*b* interconnected by bottom wall 11*d*. A circular aperture 11*f* is defined in bottom wall 11*d* and aligned with socket 42. As most clearly seen in FIG. 2, assembly 10 supports a pair of panels, or panel skins, 14 and 15 which are suspended on brackets 13 to closely overlie assembly 10 as described in the referenced application. Consequently, support assembly 10 with panels 14 and 15 mounted thereon forms a partition of an office landscaping system.

Foot assembly 20 (FIGS. 3 and 4) includes a channel member 21, generally U-shaped in cross-section, including bottom wall 22 and integral sidewalls 23*a* and 23*b* extending upwardly therefrom. Feet 30 (FIG. 4) are secured to opposite ends of channel member 21. More particularly, feet 30 each includes a downwardly inclined top wall 25 extending from and secured to sidewalls 23*a* and 23*b* by welding the portion 24 to the sidewalls. Top wall 25 inclines downwardly and outwardly from top wall 24 to end wall 26 which extends downwardly and generally perpendicularly to the floor. Bottom wall 27 extends from sidewall 26 to channel member 21 and is secured to the underside of bottom wall 22 by welding. Threaded socket 31 is secured in foot 30 to optionally receive leveling feet. Generally U-shaped tab 28 (FIGS. 3 and 4) which, in conjunction with portion 24, provides a support for clip 44, is secured between sidewalls 23*a* and 23*b* of channel member 21 in an inverted position again by welding and is spaced from top wall 24 of foot 30. Foam cover 29 (FIGS. 3 and 4) is an extrusion, pocket-shaped member in which channel member 21 and feet 30 closely interfit. Preferably, foam cover 29 is black to provide contrast between foot assembly 20 and enclosure assembly 70.

Figure 4:
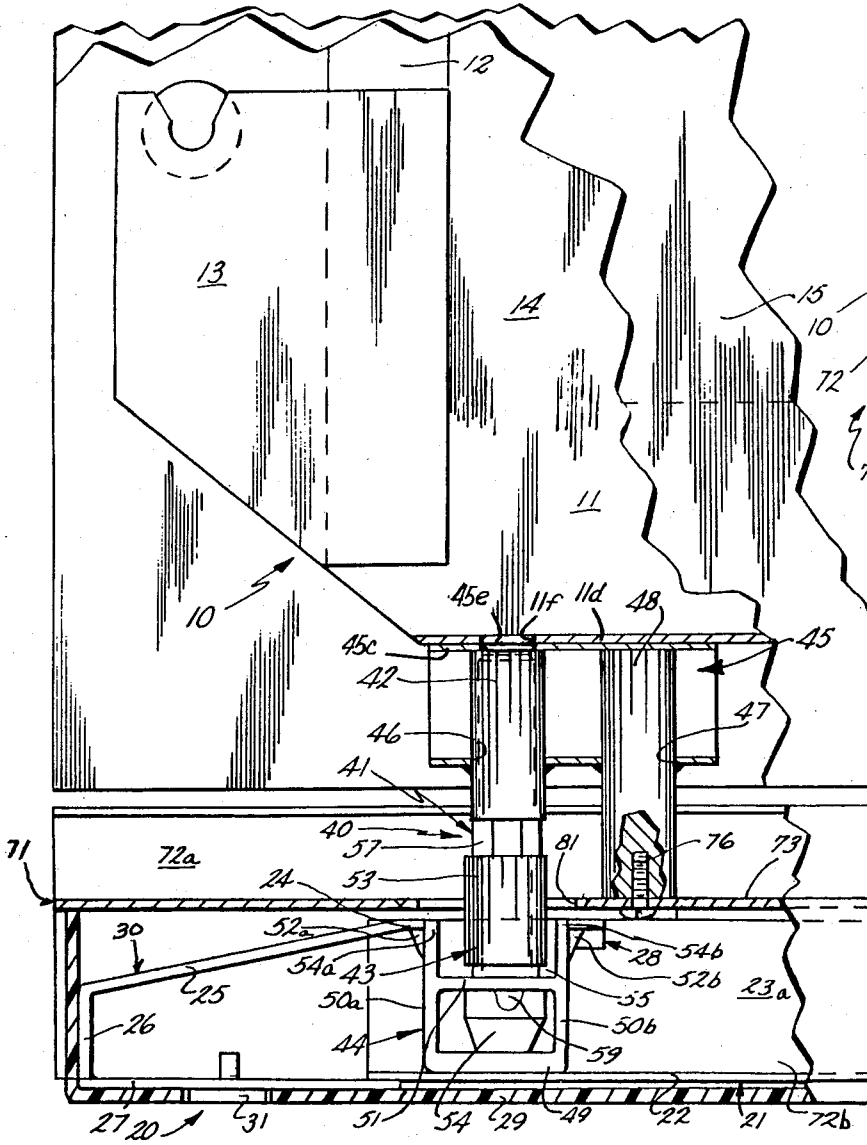
FIG. 4 is a sectional view taken along plane IV—IV in FIG. 2.
Figure 2:
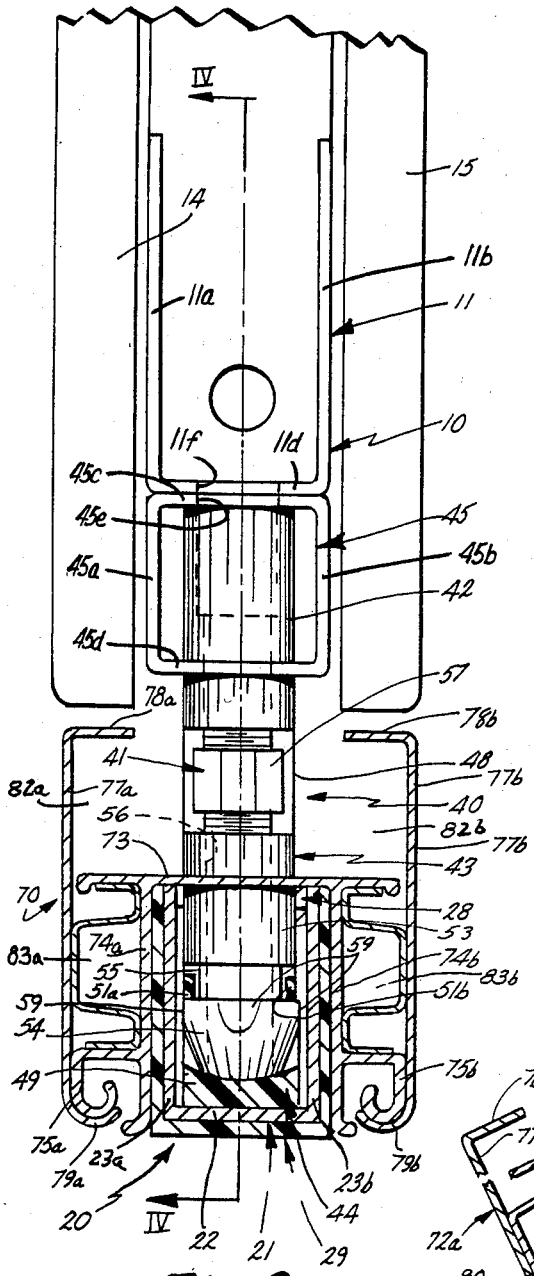
FIG. 2 is a sectional view taken along plane II—II in FIG. 1.
Figure 3:
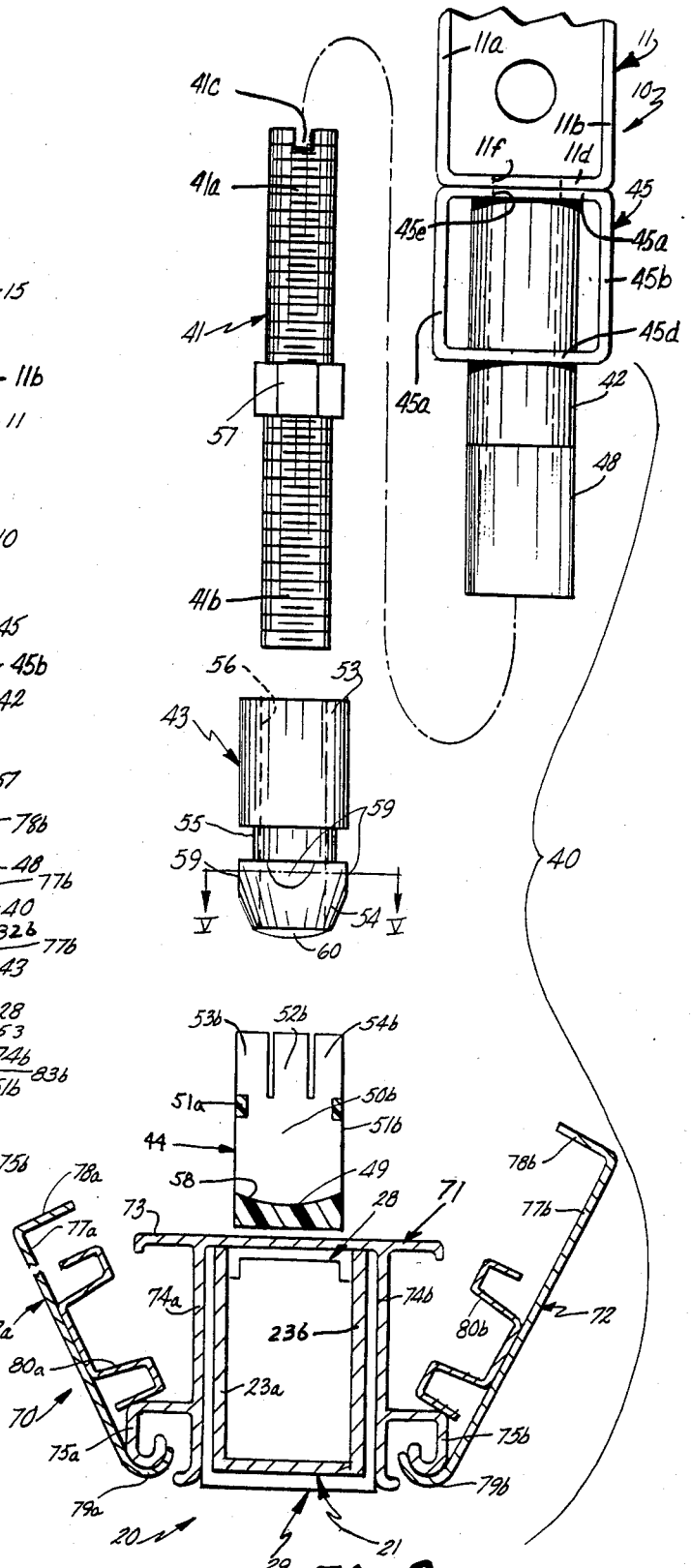
FIG. 3 is an exploded, sectional view of the support base alone as shown in FIG. 2.

As best seen in FIGS. 2, 3, and 4, adjustment assembly 40 generally includes threaded member 41 extending between socket 42 supported within tube 45 and block 43 supported on clip 44. Support tube 45 is generally square in cross section, including a pair of spaced sidewalls 45*a* and 45*b* interconnected by wall 45*c* and 45*d*, and is secured to the underside of horizontal member 11 by welding. Circular aperture 45*e* is defined by top wall 45*c* and is generally aligned with aperture 11*f* and with socket 42. Support tube 45 defines insert aperture 46 and cylinder aperture 47 in its underside (see FIG. 4). Socket 42 extends through aperture 46 and is secured within tube 45 by welding. Socket 42 is a generally cylindrical, tubular member extending the full height of support tube 45 and extending a short distance below the tube. Additionally, socket 42 is internally threaded to receive the upper end of member 41. Support stud 48 is also a generally cylindrical body and extends through support stud aperture 47 into tube 45. Support stud 48 is somewhat longer than socket 42 and consequently extends downwardly below the socket. Studs 48 provide a means for suspending enclosure assembly 70 from support assembly 10.

Clip or socket 44 (FIGS. 2, 3, and 4) is a plastic member including bottom wall 49, a pair of generally parallel and planar sidewalls 50*a* and 50*b* extending upwardly therefrom, and a pair of spaced parallel ribs 51*a* and 51*b* extending between sidewalls 50. As most clearly seen in FIG. 3, bottom walls 49 defines a concave upper surface 58 upon which block 43 rests. Ribs 51*a* and 51*b* are generally parallel to one another and generally rectangular in cross section. Integral detents 52*a* and 52*b* extend slightly outwardly from sidewalls 50*a* and 50*b*, respectively, proximate positioning extensions 53 and 54. When properly seated within foot assembly 20, clip 44 is located with bottom wall 49 abutting bottom wall 22 of channel member 21, and with detents 52*a* and 52*b* immediately below top wall 24 of foot 30 and tab 28, respectively (see FIG. 2). Additionally, positioning extensions 53 and 54 of sidewalls 50*a* and 50*b* are located adjacent top wall 24 and tab 28, respectively, to laterally maintain clip 44 in relation to foot assembly 20.

Block 43 (FIGS. 2, 3, and 4) rests on clip 44, and more particularly on upper surface 58 of bottom wall 49. Block 43 includes a generally rectangular upper portion 53, a tapered lower portion 54, and an annular groove, or channel 55 separating the two portions. Additionally, block 43 defines threaded bore 56 extending vertically through the member to receive the lower end of threaded member 41. Tapered portion 54 includes four flattened surfaces 59 equally spaced about block 43. Bottom 60 of tapered portion 54 is slightly convex to interfit with upper surface 58 of clip 44 (see FIG. 2). Annular groove 55 is substantially wider than ribs 51 so that the groove is dimensioned to loosely receive ribs 51*a* and *b*, positioned on opposite sides of block 43 in assembled assembly 40. Consequently, block 43 is free to shift longitudinally within clip 44 by means of the grooves 55 receiving ribs 51*a* and 51*b* lengthwise of foot assembly 20. Additionally, block 43 is free to pivot with respect to clip 44; more particularly, bottom 60 of lower portion 50 pivots on upper surface 58 of bottom wall 49, and block 43 shifts with respect to ribs 51.

Threaded member 41 (FIG. 3) includes a hex portion 57 separating two oppositely threaded ends. Threaded member 41 includes an upper end 41*a* threadedly secured within socket 42 and a lower end 41*b* threadedly secured within block 43 such that when the member is rotated in a first direction, the socket and block are drawn together, and when rotated in a second direction, the socket and block are forced apart. Consequently, the height of support assembly 10 above foot assembly 20 may be adjusted to level, or plumb, wall panels 14 and 15 by approximately adjusting assemblies 40. Diametrical slot or chuck means 41*c* is defined in upper end 41*a* to receive the blade of a rotatable driving member.

Enclosure assembly 70 is supported on studs 48 to slidingly engage foot assembly 20. Assembly 70 includes sealing member 71 and covers 72*a* and 72*b* pivotally mounted thereto. Sealing member 71 is a plastic extrusion and includes generally horizontal top wall 73 and sidewalls 74*a* and *b* depending downwardly therefrom to closely receive foot assembly 20 and more specifically foam cover 29. Top wall 73 extends outwardly beyond sidewalls 74 (FIGS. 2 and 3) and defines an aperture 81 (FIG. 4) through which socket 42 extends. Hinge flanges 75*a* and 75*b* extend laterally outwardly from sidewalls 74*a* and 74*b*, respectively to provide a support for covers 72. Sealing member 71 is secured to support studs 48 by passing screws 76 through top wall 73 and into the support stud as shown in FIG. 4. Consequently, sealing member 71 is maintained in fixed relationship to support assembly 10. Therefore, as threaded member 41 is rotated, sealing member 71 travels with support assembly 10 to slide along foot assembly 20 positioned between sidewalls 74.

Covers 72 extend generally the full length of sealing member 71 and include a generally planar body portion 77 having an exterior chrome black or bronze finish to contrast with foam cover 29. Each of covers 72 terminates at its upper edge in inwardly extending flange 78 and at its lower edge in inwardly curved flange 79. Flanges 79 cooperate with hinge hook flanges 75 to pivotally support covers 72 on sealing member 71. W-shaped spring clips 80*a* and *b* are secured to the inside of body portion 77*a* and 77*b*, respectively, to secure covers 72 in the closed position (FIG. 2), wherein springs 80 are compressibly secured between top wall 73 and hinges flanges 75. A plurality of wire raceways are defined between covers 72*a* and *b*, most notably raceway 82 above sealing member 71 and raceway 83*a* and *b* between spring clips 80 and sidewalls 74.

Assembly and Operation

The wall panel system is assembled by first attaching sealing member 71 to studs 48 extending from support assembly 10 by passing screws 76 through top wall 73 and into studs 48. Threaded members 41 are then threaded into sockets 42 of assembly 10. Blocks 43 are then threaded onto threaded members 41. Clips 44 are then inserted onto blocks 43 by flexing ribs 51 outwardly away from one another and inserting tapered portion 54 between the ribs. Alternatively, tapered portion 54 can be forced between ribs 51, which forces ribs apart. When bottom 60 of block 43 engages bottom wall 49 of clip 44, ribs 51 snap inwardly into groove 55.

Adjustment assembly 40, now attached to assembly 10, is then inserted and snap-fitted into foot assembly 20 by inserting clip 44 between foot 30 and tab 28 until detents 52 lock underneath top wall 24 and tab 28, respectively. When so installed, adjustment assembly 40 cannot be removed from foot assembly 20 unless clip 44 is removed from foot assembly 20.

Finally, covers 72 are mounted on sealing member 71, and the support structure is ready for shipment with panels 14 and 15. At the installation site, support assemblies 10 are interconnected as disclosed in the referenced application and panels 14 and 15 are suspended thereon.

The wall panel base construction of the present invention facilitates the leveling of support assembly 10 above foot assembly 20 by permitting the threaded members 41 to be rapidly rotated. Preferably, the panel assembly is leveled prior to mounting the panels 14 and 15 on the support assembly 10. At this stage, the slot 41*c* in each threaded member 41 is freely accessible through apertures 11*f* and 45*e* (see FIGS. 3 and 4). Rotation can be effected by inserting a driving tool, such as a screw driver, into slot 41*c* through apertures 11*e* and 45*e*. Use of a driving tool reduces adjustment time. Alternatively, rotation of threaded members 41 can be effected by grasping hex portion 57 with a wrench, even after the panels 14 and 15 are installed. If one of adjusting assemblies 40 is adjusted to a height different from that of the other adjusting assembly, both of the threaded members 41 will incline from the vertical. As assemblies 40 are inclined out of the vertical, block 43 pivots within clip 44 to accommodate the inclination. As block 43 pivots, bottom 60 of the block pivots on bottom wall 49 of clip 44; the play between ribs 51 and groove 55 permits the block to pivot with respect to the ribs. Additionally, because the upper end of member 41 is laterally fixed within socket 42, the bottom end of member 41 shifts longitudinally forcing block 43 to shift within clip 44 as groove 55 travels along ribs 51. Consequently, the block and clip cooperate to fully accommodate both the pivotal and lateral movement required during panel leveling.

Wiring may be installed within enclosure assembly 70 by pivoting covers 72 to their open position as indicated in FIG. 3. The wires are then placed between covers 72 and either sealing member 71 or adjustment assemblies 40, and covers 72 and then returned to their closed position as indicated in FIG. 2. The installed wires are securely maintained in position behind covers 72. Of course, the wires may be subsequently modified or removed altogether by reopening covers 72 and modifying the wiring configuration.

It should be understood that the above description is intended to be that of a preferred embodiment of the invention. Various alterations and modifications can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A wall panel base construction comprising:

means for supporting a wall panel;

foot means for supporting said base construction on a surface;

a block member defining a threaded bore;

means for supporting said block member within said foot means for tilting and shifting movement with respect to said foot means; and an upwardly extending threaded member having a lower threaded portion adjustably secured within said threaded bore within said block member, said threaded member having an upper portion supporting said wall panel support, means said threaded member thereby operatively supporting said panel support means on said foot means, whereby the height of said panel supporting means above said foot means can be adjusted by rotating said threaded member, and whereby said block member tilts and shifts to accommodate tilting and shifting of said threaded member with respect to said foot means to prevent said threaded member from jamming within said block member, said threaded member including an upper end defining chuck means for receiving a rotatable driving tool, said panel support means defining aperture means aligned with said threaded member for providing access to said chuck means, whereby said threaded member can be relatively rapidly rotated by applying a rotatable driving tool to said chuck means through said aperture means and rotating the tool.

2. A wall panel base construction as defined in claim 1 wherein said chuck means comprises said upper threaded member end defining a diametrical slot.

3. A wall panel base construction comprising:

panel support means for supporting a wall panel;

foot means for supporting said base construction on a surface;

block means for defining a bore;

block support means for supporting said block means on said foot means for tilting movement with respect to said foot means; and third support means for operatively supporting said panel support means on said foot means, said third support means including height adjusting means for adjusting the height of said wall panel support means above said foot means, said height adjusting means having a first portion supported within said block means and a second portion supporting said panel support means, whereby said block tilts with said height adjusting means with respect to said foot means during height adjustment, said height adjusting means including a threaded member having an upper end defining chuck means for receiving a rotatable driving tool, said panel support means defining aperture means aligned with said threaded member for providing access to said chuck means, whereby said threaded member can be relatively rapidly rotated by applying a rotatable driving tool to said chuck means through said aperture means and rotating the tool.

4. A wall panel base construction as defined in claim 3 wherein said chuck means comprises said upper threaded member end defining a diametrical slot.

5. A wall panel base construction comprising:

panel support means for supporting a wall panel, said panel support means including a horizontal support member;

foot means for supporting said base construction on a surface, said foot means located directly below said horizontal support member;

a threaded height-adjustment member having an upper end supported by said wall panel support means and a lower end supported by said foot means, said upper threaded member end located directly below said horizontal support member, said threaded member being threadedly supported by at least one of said panel support means and said foot means, whereby rotation of said threaded member effects height adjustment of said panel support means with respect to said foot means;

chuck means on said upper end of said threaded member for receiving a rotatable driving tool axially aligned with said threaded member; and said horizontal support member defining aperture means for allowing said chuck means to be freely accessed therethrough, whereby said threaded member can be relatively rapidly rotated by applying a rotatable driving tool to said chuck means through said horizontal support member and rotating said driving tool.

6. A wall panel base construction as defined in claim 5 wherein said threaded member is threadedly supported within said panel support means.

7. A wall panel base construction as defined in claim 6 wherein said threaded member is threadedly supported in both of said panel support means and said foot means to improve the mechanical advantage of said threaded member.

8. A wall panel base construction as defined in claim 5 wherein said chuck means comprises said upper threaded member end defining a diametrical slot into which a blade of a rotational driving tool can be inserted.

9. A wall panel base construction as defined in claim 5 further comprising grasping means on said threaded member for receiving a wrench-like tool extending laterally of said threaded member to effect rotation of said threaded member.

10. A wall panel base construction as defined in claim 9 wherein said grasping means comprises a hex portion.

* * * * *

UNITED STATES PATENT AND TRADEMARK OFFICE

CERTIFICATE OF CORRECTION

PATENT NO. : 4,555,880

DATED : December 3, 1985

INVENTOR(S) : Larry P. Gzym

It is certified that error appears in the above-identified patent and that said Letters Patent is hereby corrected as shown below:

Column 3, Line 47:
"side wall" should be --side walls--

Column 3, Line 61:
"includes" should be --include--

Column 4, Line 17:
After "by" insert --top--

Column 4, Line 40:
"walls" should be --wall--

Column 5, Line 17:
"approximately" should be --appropriately--

Column 5, Line 49:
"portion" should be --portions--

Column 5, Line 52:
"hinges" should be --hinge--

UNITED STATES PATENT AND TRADEMARK OFFICE

CERTIFICATE OF CORRECTION

PATENT NO. : 4,555,880

DATED : December 3, 1985

INVENTOR(S) : Larry P. Gzym

It is certified that error appears in the above-identified patent and that said Letters Patent is hereby corrected as shown below:

Column 6, Line 49:
"and" should be --are--

Column 7, Claim 1, Line 11:
"support, means" should be --support means,--

Signed and Sealed this

*Twenty-second* Day of *April 1986*

[SEAL]

*Attest:*

DONALD J. QUIGG

*Attesting Officer*

*Commissioner of Patents and Trademarks*